US007227523B2

(12) United States Patent
Ishikawa et al.

(10) Patent No.: US 7,227,523 B2
(45) Date of Patent: Jun. 5, 2007

(54) LIQUID CRYSTAL DISPLAY DEVICE AND INSPECTING METHOD THEREOF

(75) Inventors: Kenichiro Ishikawa, Kanagawa (JP); Hisashi Takita, Kanagawa (JP); Joe Yoshida, Kanagawa (JP)

(73) Assignee: Sony Corporation (JP)

( * ) Notice: Subject to any disclaimer, the term of this patent is extended or adjusted under 35 U.S.C. 154(b) by 576 days.

(21) Appl. No.: 10/751,529

(22) Filed: Jan. 6, 2004

(65) Prior Publication Data

US 2004/0141131 A1 Jul. 22, 2004

(30) Foreign Application Priority Data

Jan. 21, 2003 (JP) ..... P2003-012506

(51) Int. Cl.
*G09G 3/36* (2006.01)

(52) U.S. Cl. ..... 345/87; 345/92

(58) Field of Classification Search ..... 345/87–104, 345/204, 690, 904; 365/100, 189.07, 210, 365/207

See application file for complete search history.

(56) References Cited

U.S. PATENT DOCUMENTS 6,314,014 B1 * 11/2001 Lowrey et al. ..... 365/100
6,795,046 B2 * 9/2004 Janssen et al. ..... 345/87
7,034,786 B2 * 4/2006 Ham ..... 345/88
7,106,287 B2 * 9/2006 Ham ..... 345/89

FOREIGN PATENT DOCUMENTS

| | | |
|---|---|---|
| JP | 03-142499 | 6/1991 |
| JP | 04-288588 | 10/1992 |
| JP | 05-010999 | 1/1993 |
| JP | 2000-047255 | 2/2000 |

OTHER PUBLICATIONS

Japanese Office Action issued on Jun. 20, 2006.

* cited by examiner

*Primary Examiner*—Nitin I. Patel
(74) *Attorney, Agent, or Firm*—Rader Fishman & Grauer PLLC; Ronald P. Kananen

(57) ABSTRACT

Output signals of two adjacent data signal lines DA1 to DAn and DB1 to DBn are supplied to comparators CMP1 to CMPn, respectively. When pixels are inspected, different signal potentials are input to signal input terminals 14*a* and 14*b*. Signals are written to pixels from the first row to the last row. Thereafter, a pre-charging process is performed by supplying a voltage to the terminals 14*a* and 14*b*. Thereafter, signals are read from all the pixels from the first row to the last row. The signal potentials that have been read are compared by the comparators CMP1 to CMPn. Depending on the relations of voltages written as digitally-compared outputs of the comparators CMP1 to CMPn, defective pixels are detected.

12 Claims, 11 Drawing Sheets

LIQUID CRYSTAL DISPLAY DEVICE AND INSPECTING METHOD THEREOF

BACKGROUND OF THE INVENTION

1. Field of the Invention

The present invention relates to a liquid crystal display device for use with an active-matrix-type liquid crystal display device and an inspecting method thereof, in particular, an inspecting method for inspecting defective pixels on a substrate.

2. Description of the Related Art

In an active-matrix-type liquid crystal display device, switching thin film transistors (TFT) and transparent electrodes are disposed at intersections of data signal lines and gate signal lines so as to control voltages of the transparent electrodes. For example, Si-type liquid crystal display panels that are small and have high resolutions are being increasingly used for cellular phone units, personal digital assistants (PDA), and so forth.

A Si-type liquid crystal display panel is structured in such a manner that liquid crystal is sealed between a large scale integrated circuit (LSI), on which a transistor, a capacitor, and a pixel electrode (for example, a reflection plate) are formed for each pixel on an Si wafer and transparent electrodes coated on a glass substrate. The LSI is produced by, for example, the complementary metal oxide semiconductor (CMOS) process. In the specification, LSI on which reflection electrodes have not yet been formed or in which liquid crystal has not yet been sealed is referred to as a liquid crystal display device substrate.

Generally, since the area of pixel portions of an active matrix liquid crystal display device substrate is large, the non-defect rate of the pixel portions is lower than that of a driving circuit portion. Thus, the production cost of the substrate adversely becomes high. As a result, it is important to improve the non-defect rate of the pixel portions. To improve the non-defect rate, it is essential to develop a method for inspecting defective pixels. As a method for inspecting defective pixels, after filling them with liquid crystal, the liquid crystal is driven and the display image is analyzed by an image analyzing unit. As another method, defective pixels are visually inspected.

However, in such methods, since a liquid crystal display device is actually driven and an image is displayed thereon, defective pixels are inspected. Thus, a long measuring time is required and high productivity cannot be expected. In addition, when defective pixels are inspected after filling them with liquid crystal, even if defective pixels are detected, the liquid crystal display device should be disposed. This is because from view point of cost, it is not practical to remove liquid crystal the liquid crystal display device, correct the defective pixels, and then fill the liquid crystal in the liquid crystal display device. Thus, a technology for inspecting pixels and separating them as non-defective pixels and defective pixels before filling them with liquid crystal is important because the production cost can be reduced and defect information can be fed back to the production process in an early production stage.

A method for inspecting defective pixels of a liquid crystal display device before filling them with liquid crystal is described in a related art reference (patent document 1) disclosed as Japanese Patent Publication No. 2728748.

FIG. 1 shows a liquid crystal display device described in the related art reference (patent document 1). Reference numeral 1 represents a shift resister as a horizontal scanning circuit. Reference numeral 2 represents a gate driving circuit as a vertical scanning circuit. For simplicity, it is assumed that the liquid crystal display device has (4×4=16) pixels. Parallel output terminals of the shift resister 1 are connected to respective gates of analog switches 3*a* to 3*d*. Drains of the analog switches 3*a* to 3*d* are commonly connected to a drain of a signal switch 4. The drain of the signal switch 4 is grounded through a drain and a source of a reset switch 5. In addition, the drain of the signal switch 4 is connected to a source follower circuit 6.

Four data signal lines D1, D2, D3, and D4 are led out of sources of the analog switches 3*a* to 3*d*. Gate signal lines G1, G2, G3, and G4 are led out of outputs of the gate driving circuit 2. At each intersection of the data signal lines D1 to D4 and the gate signal lines G1 to G4, a pixel portion is disposed. Each pixel portion is composed of a pixel transistor S and a capacitor Cs. A pixel electrode (not shown) is connected to a capacitor Cs in parallel. Liquid crystal is sealed between pixel electrodes and their opposite transparent electrodes. The transparent electrodes are coated on the glass substrate.

In the normal operation of the device, pixels to which signals are sent from the shift register 1 and the gate driving circuit 2 through data signal lines and gate signal lines become active. A signal potential applied through the signal switch 4 is led to a data signal line and written to a pixel through a pixel transistor S. A capacitor Cs disposed at each pixel is an auxiliary capacitor that holds the signal potential until the next writing operation is performed.

The foregoing related art reference (patent document 1) describes a method for determining a defective pixel due to a defective transistor S, an insufficient capacitance of a capacity Cs, or the like of a pixel portion before filling it with liquid crystal. First of all, a write mode that causes a high level (sometimes denoted by "H") voltage always to be generated through the signal switch 4 is set. In the write mode, a gate electrode, for example, G2, is set to "H" The outputs of the shift resister 1 are turned on in succession. Thus, the transistors 7 of the four pixel portions on the second row of the pixel selection are turned on in succession. As a result, signal charges are written to these pixel portions in succession.

After signal charges have been written to all the pixel portions, the gate of the signal switch 4 becomes the ground potential. The drain sides of the analog switches 3*a* to 3*d* become a high impedance state. In other words, a read mode is set. For example, the gate signal line G2 on the second row is set to "H". Signals of all the pixel portions on the second row are read in succession. Whenever a signal of one pixel is read, the reset switch 5 is turned on. Before a signal of the next pixel portion is read, the reset operation is performed.

A signal that is read from each pixel is output through the analog switches 3*a* to 3*d* and the source follower circuit 6. An output signal of the source follower circuit 6 is observed. Corresponding to the output signal of the source follower circuit 6, pixels are inspected for defective ones. If a pixel portion at the second row and third column is defective, the source follower circuit 6 does not output a signal corresponding to the pixel portion. As a result, it can be determined that the pixel portion is defective. In other words, the technology described in the related art reference (patent document 1) is a method for detecting a waveform corresponding to a discharge amount so as to detect a defective pixel.

However, according to the method described in the related art reference (patent document 1), since defective pixels are evaluated one by one, when a high resolution liquid crystal display panel having more than 1,000,000 and 2,000,000 pixel such as (1280×1024) and (1920×1200), is evaluated for defective pixels, it takes a long measuring time to evaluate all the pixels. In addition, a system that evaluates an analog detection waveform in high accuracy would be required. Moreover, the parasitic capacitance of a data signal line is much larger (for example, 200 times larger) than the capacitance of a capacitor element disposed for each pixel. In addition, the parasitic capacitances deviate for each LCD panel. Moreover, the evaluation system, for example, a tester system has a capacitance. Since capacitances of each device and each evaluation system deviate, an obtained detected waveform deviates in, for example, the amplitude thereof. As a result, without careful consideration of a parasitic capacitance of data signal lines and a capacitance of the tester, capacitances of pixels cannot be accurately evaluated with detected values.

OBJECTS AND SUMMARY OF THE INVENTION

Therefore, an object of the present invention is to provide a liquid crystal display device and an inspecting method that allow pixels to be inspected for defective ones with a digital signal in a short inspecting time and a high accuracy without the influence of parasitic capacitances of data signal lines and an evaluating system.

To solve the foregoing problem, a first aspect of the present invention is a liquid crystal display device having a plurality of data signal lines, a plurality of gate signal lines disposed perpendicular to the data signal lines, pixel transistors disposed at intersections of the data signal lines and the gate signal lines, and capacitors disposed at the intersections, the pixel transistors each having a control electrode, an input electrode, and an output electrode, and at the intersections, the control electrodes of the pixel transistors being connected to the respective gate signal lines, the input electrodes of the pixel transistors being connected to the respective data signal lines, and the output electrodes of the pixel transistors being connected to the respective capacitors, the liquid crystal display device comprising: means disposed at intervals of M (positive integer) lines of the data signal lines for selecting N (positive integer, M>=N) data signal lines from the M data signal lines and comparing voltages of the N data signal lines.

A second aspect of the present invention is a liquid crystal display device having a plurality of data signal lines, a plurality of gate signal lines disposed perpendicular to the data signal lines, pixel transistors disposed at intersections of the data signal lines and the gate signal lines, and capacitors disposed at the intersections, the pixel transistors each having a control electrode, an input electrode, and an output electrode, and at the intersections, the control electrodes of the pixel transistors being connected to the respective gate signal lines, the input electrodes of the pixel transistors being connected to the respective data signal lines, and the output electrodes of the pixel transistors being connected to the respective capacitors, the liquid crystal display device comprising: means disposed at intervals of two of the data signal lines for comparing voltages of the two data signal lines.

A third aspect of the present invention is a liquid crystal display device having a plurality of data signal lines, a plurality of gate signal lines disposed perpendicular to the data signal lines, pixel transistors disposed at intersections of the data signal lines and the gate signal lines, and capacitors disposed at the intersections, the pixel transistors each having a control electrode, an input electrode, and an output electrode, and at the intersections, the control electrodes of the pixel transistors being connected to the respective gate signal lines, the input electrodes of the pixel transistors being connected to the respective data signal lines, and the output electrodes of the pixel transistors being connected to the respective capacitors, the liquid crystal display device comprising: a plurality of auxiliary data signal lines disposed corresponding to the data signal lines and connected to the output electrodes of the respective pixel transistors; and calculating means connected to one of the auxiliary data signal lines and one of the gate signal lines.

A fourth aspect of the present invention is a method for inspecting a liquid crystal display device having a plurality of data signal lines, a plurality of gate signal lines disposed perpendicular to the data signal lines, pixel transistors disposed at intersections of the data signal lines and the gate signal lines, and capacitors disposed at the intersections, the pixel transistors each having a control electrode, an input electrode, and an output electrode, and at the intersections, the control electrodes of the pixel transistors being connected to the respective gate signal lines, the input electrodes of the pixel transistors being connected to the respective data signal lines, and the output electrodes of the pixel transistors being connected to the respective capacitors, the method comprising the steps of: supplying two predetermined different voltages to two adjacent data signal lines and storing the two predetermined different voltages to capacitors connected to the two signal lines through the respective pixel transistors; and comparing voltages that are read from the capacitors to the two data signal lines.

A fifth aspect of the present invention is a method for inspecting a liquid crystal display device having a plurality of data signal lines, a plurality of gate signal lines disposed perpendicular to the data signal lines, pixel transistors disposed at intersections of the data signal lines and the gate signal lines, and capacitors disposed at the intersections, the pixel transistors each having a control electrode, an input electrode, and an output electrode, and at the intersections, the control electrodes of the pixel transistors being connected to the respective gate signal lines, the input electrodes of the pixel transistors being connected to the respective data signal lines, and the output electrodes of the pixel transistors being connected to the respective capacitors, the method comprising the steps of: supplying different voltages to two data signal lines and storing the two different voltages to the capacitors through the respective pixel transistors connected to the two data signal lines; pre-charging a reference potential to all the data signal lines and reading voltages stored in the capacitors to the two data signal lines; and comparing the voltages of the two data signal lines.

Unlike a method for evaluating an analog waveform, according to the present invention, defective pixels can be detected with a digital signal. Thus, a system that accurately evaluates a detected analog waveform is not required. In addition, without the influence of deviations of a parasitic capacitance of data signal lines and a capacitance of a tester system, pixels can be accurately inspected for defective ones.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENTS

Next, with reference to the accompanying drawings, embodiments of the present invention will be described.

First Embodiment

Figure 1:
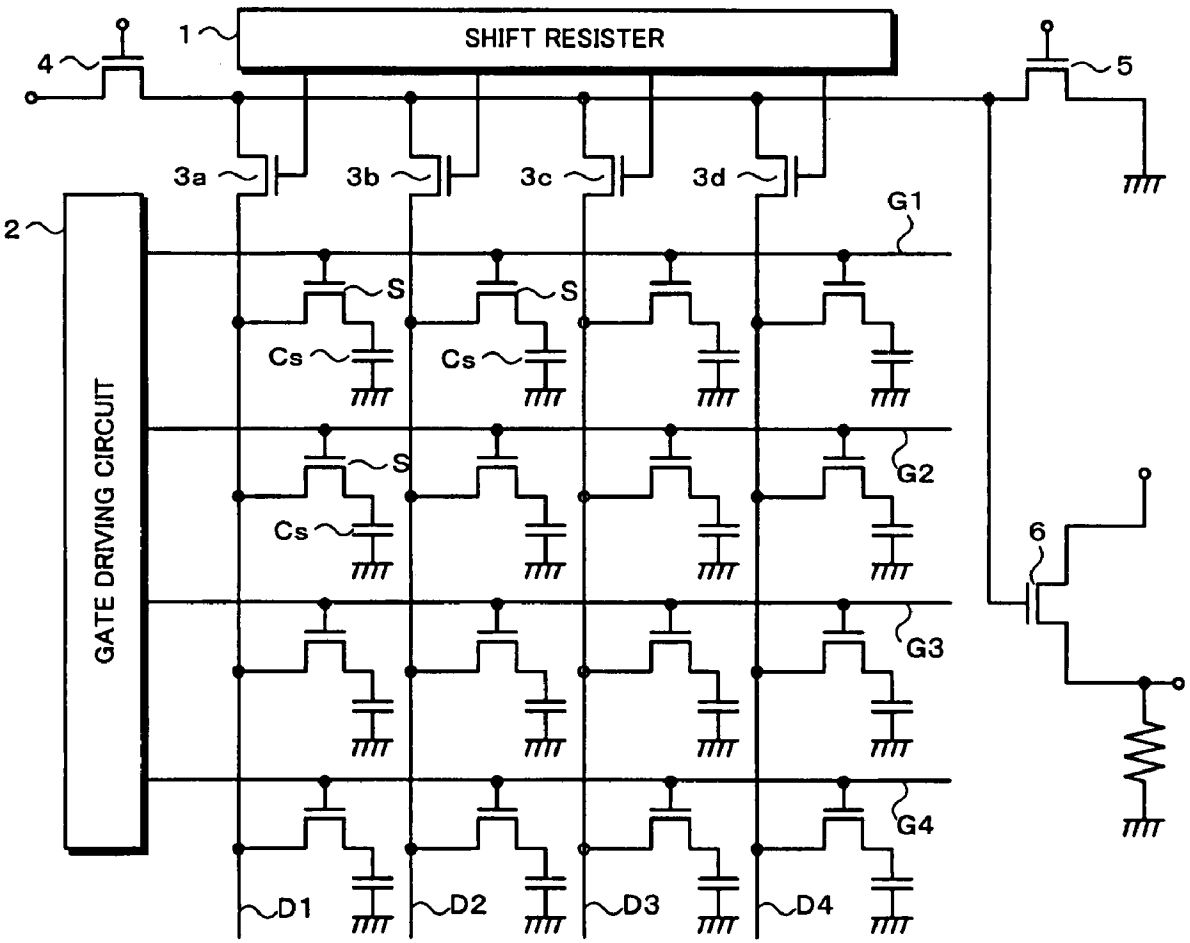
FIG. 1 is a circuit connection diagram describing a liquid crystal display device substrate according to a related art reference.
Figure 2:
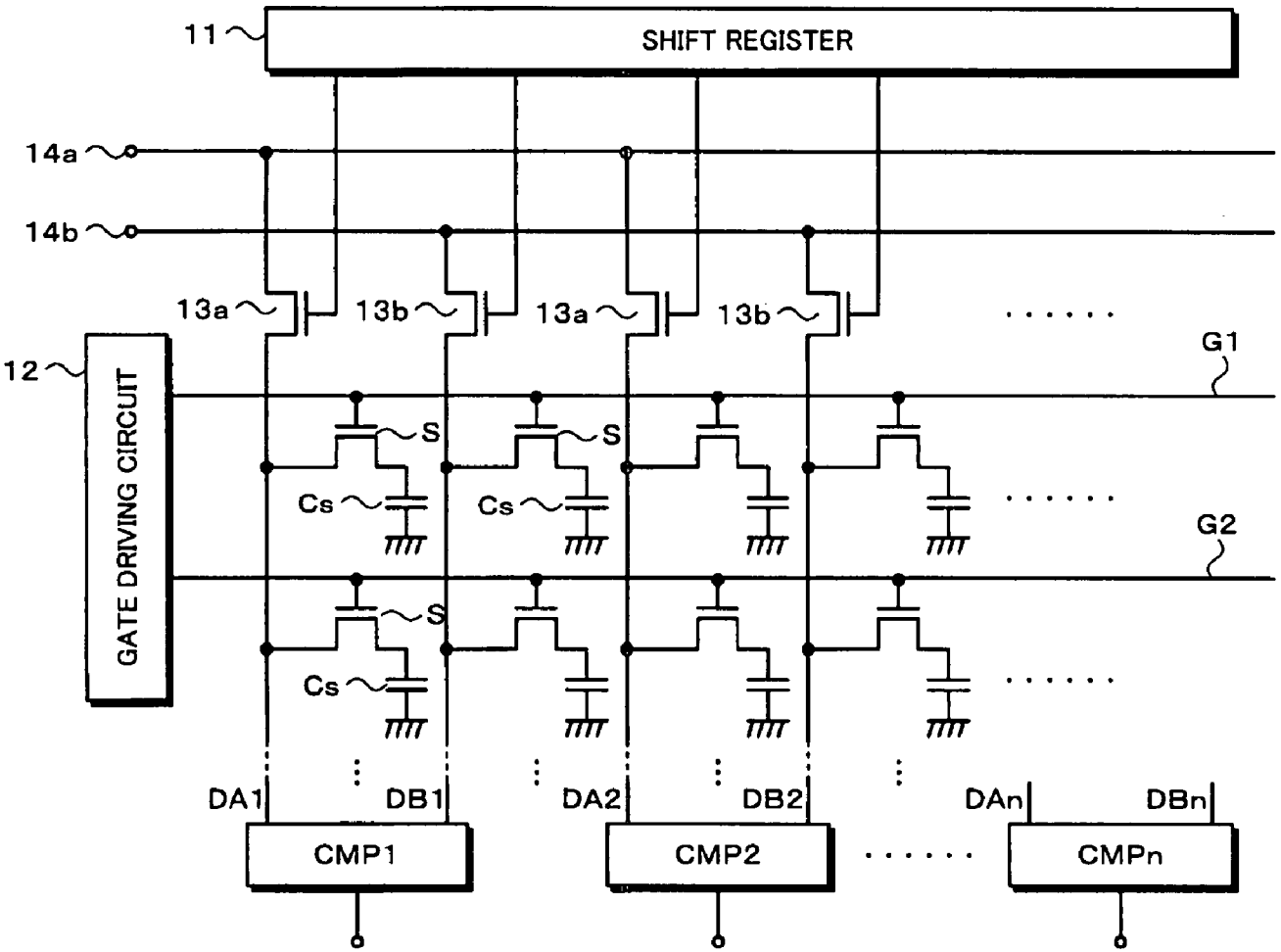
FIG. 2 is a circuit connection diagram showing a structure of an embodiment of the present invention.

FIG. 2 shows a structure of an embodiment of the present invention. Reference numeral 11 represents a shift resistor that operates as a horizontally-scanning circuit. Reference numeral 12 represents a gate driving circuit that operates as a vertically-scanning circuit. When the number of pixels is represented by (H×V), H data signal lines and V gate signal lines are disposed. Each of the pixel portions is disposed at each of the intersections of the data signal lines and the gate signal lines. Each of the pixel portions is composed of a pixel transistor S and a capacitor Cs. A pixel electrode is connected to a capacitor Cs in parallel. Liquid crystal is sealed between a pixel electrode and an opposite electrode.

In the structure shown in FIG. 2, two adjacent pixels are activated at a time. In other words, drains of odd-numbered transistors 13*a* are connected to one input signal terminal 14*a*. On the other hand, drains of even-numbered transistors 13*b* are connected to another input terminal 14*b*. Odd-numbered data signal lines DA1, DA2, . . . , and DAn are connected to sources of the transistors 13*a* where there is a relation of n=H/2. Even-numbered data signal lines DB1, DB2, . . . , and DBn are connected to sources of the transistors 13*b*. m-th (where m=1 to n) data signal lines are denoted by DAm, DBm.

For example, output signals of two adjacent data signal lines are supplied to input terminals of comparators CMP1, CMP2, . . . , and CMPn. M-th comparator is denoted by CMPm. The comparators CMP1 to CMPn are formed on a semiconductor substrate, for example, a Si substrate, on which the pixel portions are formed by the CMOS process.

When a potential that is input from one data signal line DAm is higher than a potential that is input form another data signal line DBm, a comparator CMPm generates a compared output "H". In contrast, when the potential of the data signal line DAm is lower than the potential of the data signal line DBm, the comparator CMPm generates a compared output "L". By observing digital compared outputs of the comparators CMP1 to CMPm, defective pixels are detected.

In the normal operation, parallel signals are input to the signal input terminals 14*a* and 14*b*. For example, the first transistors 13*a* and 13*b* are turned on. As a result, the first gate signal line G1 becomes "H". Thus, two adjacent pixel transistors are turned on at the same time. Signal charges are stored in capacitors connected to the transistors that have been turned on. After one frame is completed and until the next signals are written, the signal potentials are held by the capacitors Cs. In such a manner, signals are written to two horizontally-adjacent pixels at a time.

It should be noted that the structure of which two horizontally adjacent pixels are activated at a time is just an example. In other words, two non-adjacent pixels may be activated at a time. Alternatively, an even number of pixels that are four or more pixels may be activated at a time. The reason why a plurality of pixels are activated at a time is to quickly write and read signals to and from all pixels of one panel in the normal operation.

Outputs of the comparators CMP1 to CMPn may be directly led out. However, this would result in increasing the number of terminal pins of the LSI. When the number of pixels in the horizontal direction is H=1920, the number of pins becomes n=960. Thus, it is necessary to lead out 960 terminals. A structure that allows such a problem to be solved is shown in FIG. 3.

Figure 3:
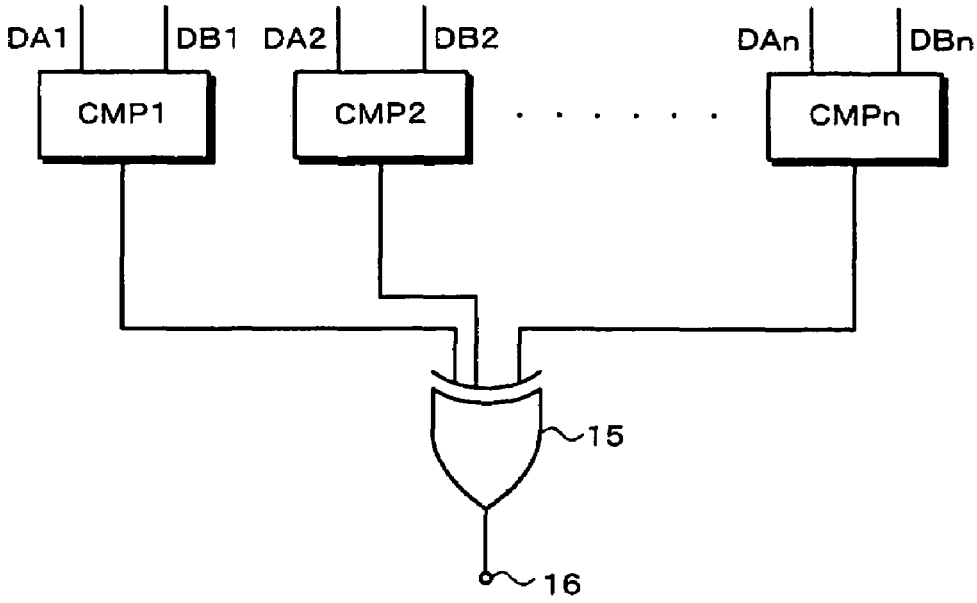
FIG. 3 is a circuit connection diagram showing an example of a structure for processing outputs of comparators according to the embodiment of the present invention.

For simplicity, FIG. 3. shows only the comparators CMP1 to CMPn of the structure shown in FIG. 2. All outputs of the comparators CMP1 to CMPn are supplied to an exclusive-OR gate 15. The exclusive-OR gate 15 is formed on a semiconductor substrate, such as an Si substrate, on which the pixel portions are formed by the CMOS process.

When all pixel portions connected to a particular gate signal line Gm are normal, the outputs of the all comparators CMP1 to CMPn become "H" or "L". As a result, the output of the exclusive-OR gate 15 becomes "L". If at least one of the pixels is not normal, the output of the exclusive-OR gate 15 becomes "H". Thus, in the structure shown in FIG. 3, it can be determined whether or not pixels connected to the gate signal lines are defective with the output of the exclusive-OR gate 15.

Figure 4:
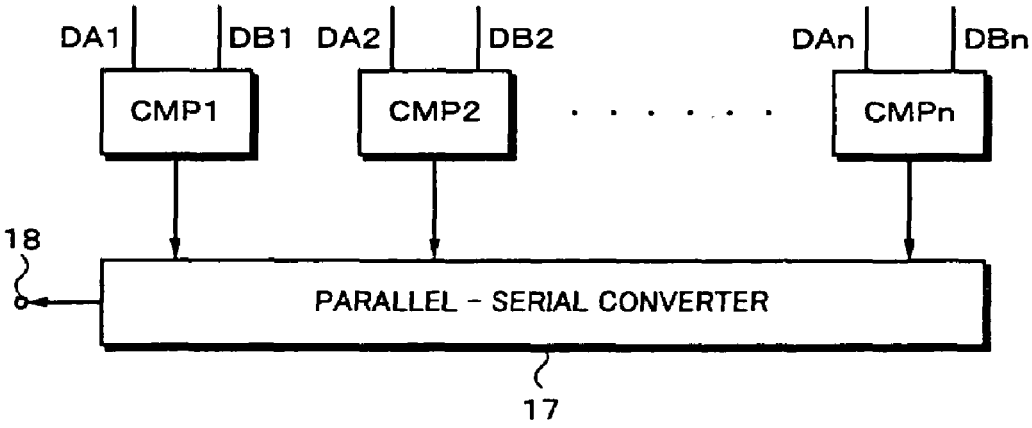
FIG. 4 is a schematic diagram showing another example of the structure for processing the outputs of the comparators according to the embodiment of the present invention.

FIG. 4 shows another example of the structure for processing the outputs of the comparators CMP1 to CMPn. The outputs of the comparators CMP1 to CMPn for pixel portions connected to a particular gate signal line Gm are supplied to parallel input terminals of a parallel—serial converter 17. The parallel—serial converter 17 successively outputs output signals of n comparators that are input at a time from a serial output terminal 18. The parallel—serial converter 17 is formed on the semiconductor substrate, for example, an Si substrate, on which the pixel portions and the comparators CMP1 to CMPn are formed by the CMOS process. In the structure shown in FIG. 4, the positions of defective pixels can be determined according to the positions of serial data that is not an expected value.

Figure 5:
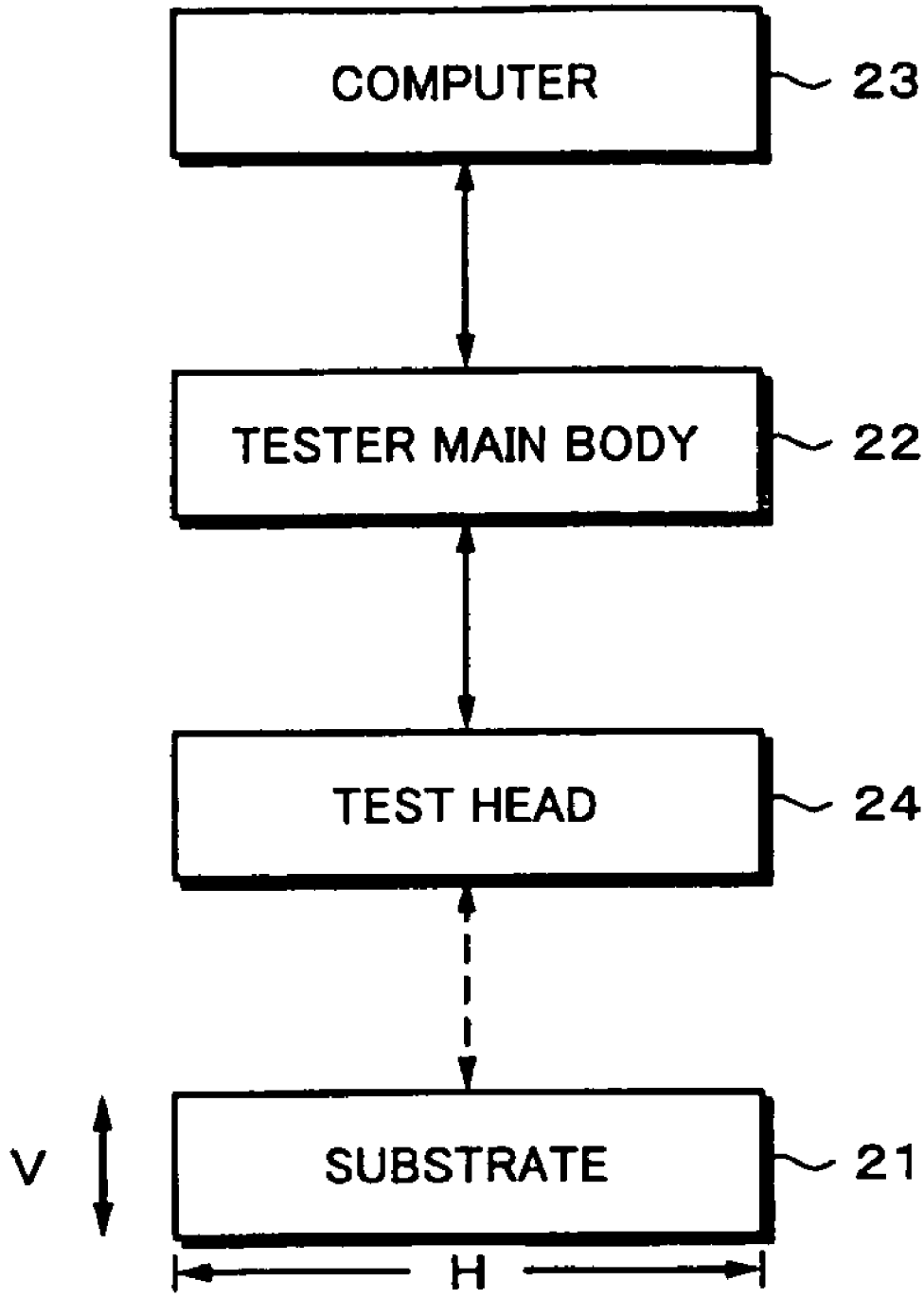
FIG. 5 is a block diagram describing an outline of an inspecting system according to the embodiment of the present invention.

FIG. 5 shows an outline of an example of the structure for inspecting a substrate. In FIG. 5, reference numeral 21 represents a substrate under test. A LSI tester is composed of a tester main body 22, a computer 23, and a test head 24. An application program for testing the substrate 21 has been installed to the computer 23. The tester main body 22 generates a signal necessary for testing the substrate 21. The generated signal is supplied to the substrate 21 through the test head 24. The outputs of the comparators CMP1 to CMPn and the output of the exclusive-OR gate 15 or the serial output of the parallel—serial converter 17 are supplied to the tester main body 22 or the computer 23 through the test head 24. By analyzing the compared outputs, defective pixels are tested.

Figure 6:
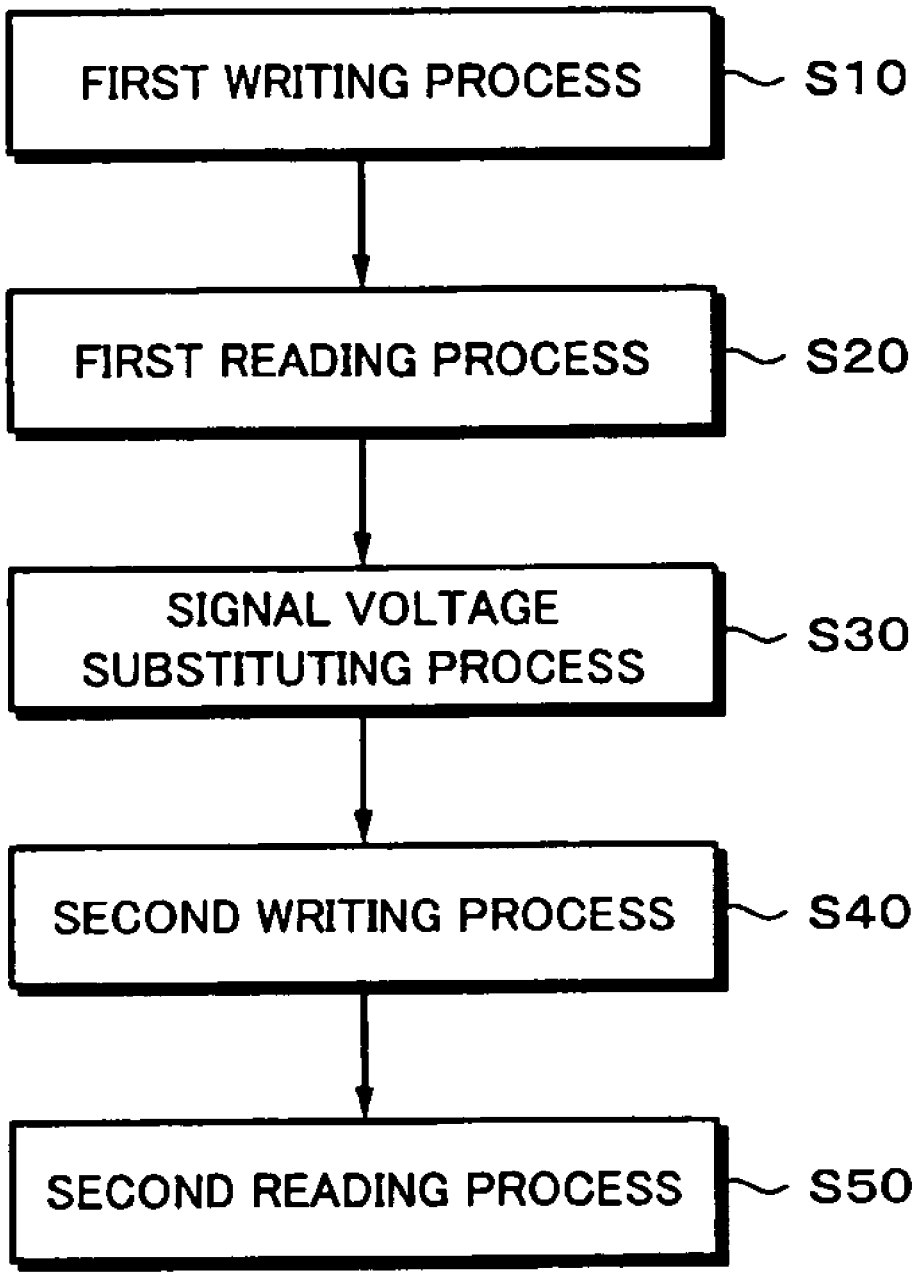
FIG. 6 is a flow chart showing steps of a defect inspecting method of a substrate according to the embodiment of the present invention.

FIG. 6 shows an outline of an example of a method of inspecting defective pixels of a liquid crystal display device substrate according to the embodiment of the present invention. First of all, a predetermined voltage Va is applied to the input terminal 14*a*. In addition, a predetermined voltage Vb (where Va>Vb) is applied to the other input terminal 14*b* so as to perform a first writing process S10. The difference between the voltage Va and the voltage Vb is relatively small, so that the relation thereof varies with a defective pixel. Thereafter, a first reading process S20 is performed. A defective pixel is inspected with a compared output obtained by the reading process S20.

Thereafter, a signal voltage substituting process S30 is performed. In other words, the predetermined voltage Vb is applied to the input terminal 14*a*. The predetermined voltage Va (where Va>Vb) is applied to the other input terminal 14*b*. Thereafter, a second writing process S40 and a second reading process S50 are performed. Defective pixels are inspected with a compared output obtained by the second reading process S50.

Figure 7:
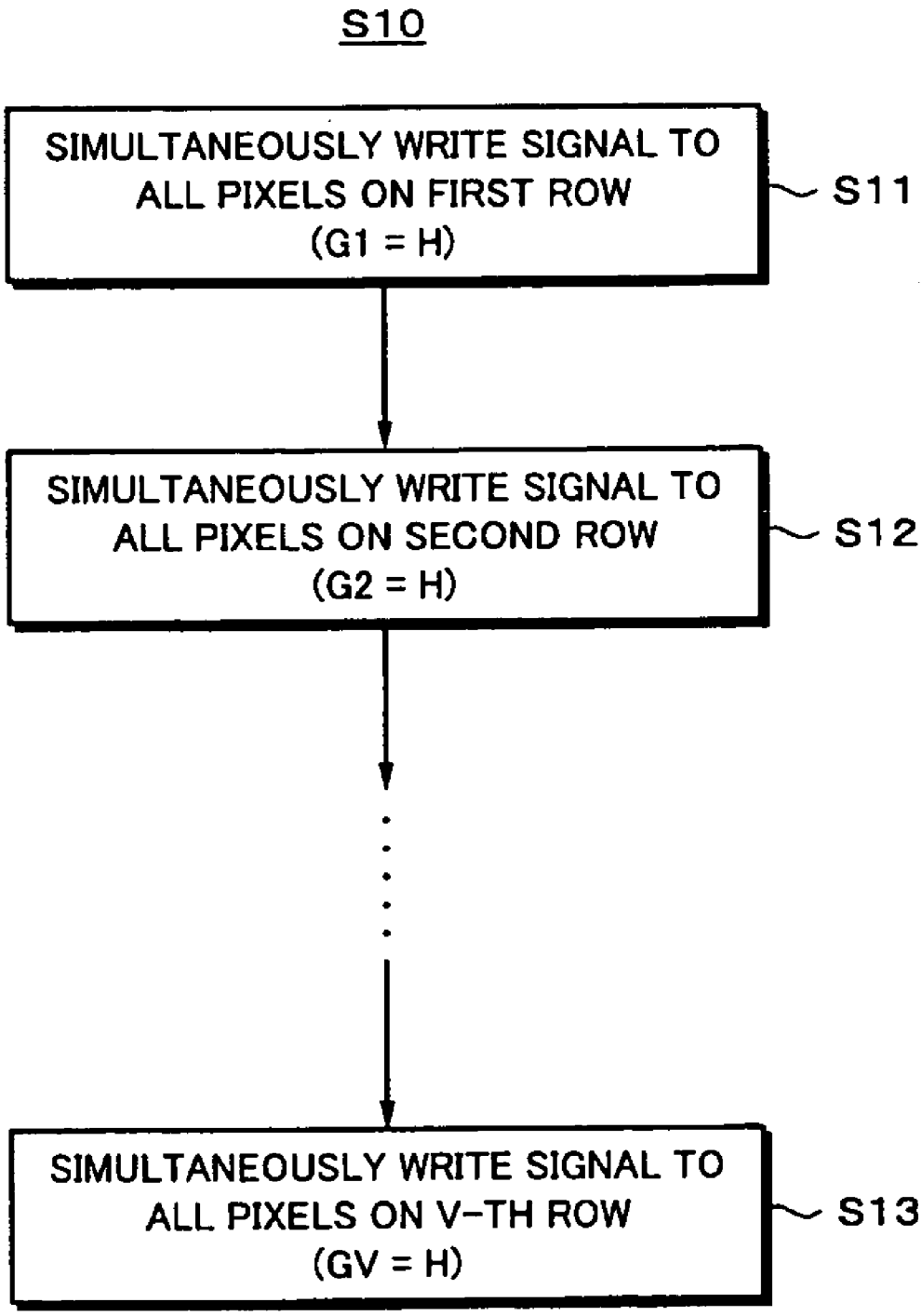
FIG. 7 is a flow chart showing details of steps of a writing process of the defect inspecting method.

Next, a method for inspecting defective pixels according to the embodiment of the present invention will be described in detail. FIG. 7 shows the first writing process S10 in detail. In the writing process, a signal is simultaneously written to all pixels on the first row of the substrate. Thereafter, a signal is simultaneously written to all pixels on the second row of the substrate. Thereafter, a signal is simultaneously written to pixels on each of the third row to the last V row. Thereafter, the writing process S10 is completed.

When a signal is written to pixels on the first row, at a real driving timing, the gate signal line G1 is activated by the gate driving circuit 12 so as to turn on all pixel transistors connected to the gate line G1. Thereafter, at a real driving timing, the predetermined signal potentials Va and Vb (where Va>Vb) are applied to the input terminals 14*a* and 14*b* so as to turn on both the switch transistors 13*a* and 13*b* that cause data signal lines to be active. As a result, a signal potential is stored in capacitors Cs of the pixels connected to the gate signal line G1.

The potential Va is stored in the capacitors Cs of the pixel transistors S through the data signal lines DA1 to DAn connected to the sources of the transistors 13*a*. The potential Vb is stored in the capacitors Cs of the pixel transistors S through the data signal lines DB1 to DBn connected to the sources of the transistors 13*b*. Proper values are selected as the signal potentials Va and Vb so that defective pixels can be detected. The signal potentials Va and Vb are, for example, Va=5 V and Vb=4 V.

At a real driving timing, the gate driving circuit 12 causes the gate signal line G1 to be inactive so as to turn off all the pixel transistors S on one row connected to the gate signal line G1. In this state, for a real driving period, for example, one frame period, the signal potential Va or Vb is stored in the capacitors Cs.

Figure 8:
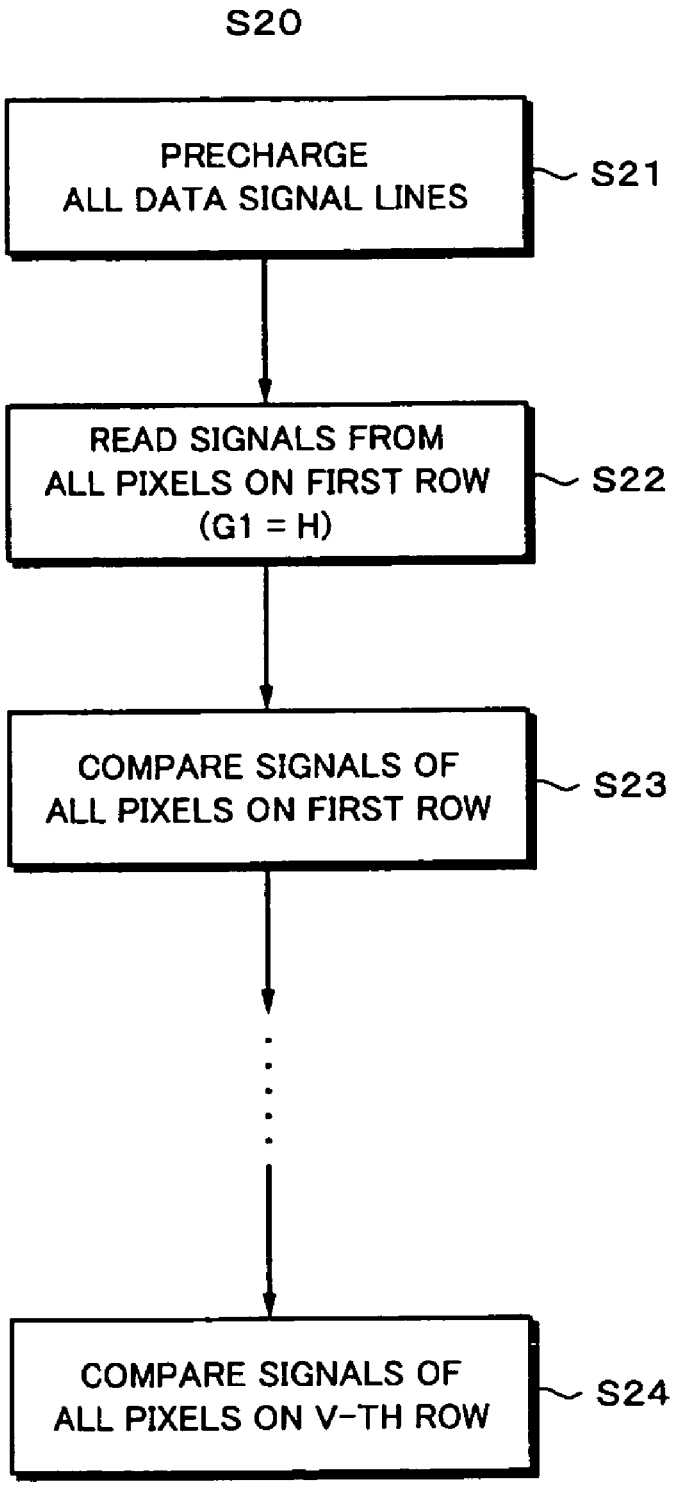
FIG. 8 is a flow chart showing details of steps of a reading process of the defect inspecting method.

FIG. 8 shows the first reading process in detail. In the reading process, at step S21, while the signal potential is being stored, all the data signal lines are pre-charged to a reference potential. In other words, a reference potential Vp is applied to both the input terminals 14*a* and 14*b*. The shift register 11 causes all the switch transistors 13*a* and 13*b* to be turned on simultaneously so as to cause all the data signal lines DA1 to DAn and DB1 to DBn to be active. As a result, all the data signal lines DA1 to DAn and DB1 to DBn are precharged to the reference potential Vp. Thereafter, all the switch transistors 13*a* and 13*b* are turned off so as to cause them to be in a high impedance state. As a result, the reference potential is prevented from being written to the data signal lines DA1 to DAn and DB1 to DBn. The reference potential Vp may be any potential, for example, Vp=4.5 V.

After the capacitors Cs are kept at the signal potential for a real driving period, a reading process S22 is performed for pixels on the first row. In other words, the gate driving circuit 2 causes the gate signal line G1 to be active again so as to turn on all the pixel transistors S on the first row connected to the gate signal line G1. As a result, the signal potentials stored in capacitors Cs of pixels connected to the gate signal line G1 are read to the data signal lines.

In a comparing process S23 for pixels on the first row, the comparators CMP1 to CMPn compare signal potentials that are read from the capacitors Cs of all the pixels on the first row. As a result, n compared outputs are obtained. The signal potential Va has been written to the data signal lines DA1 to DAn. The signal potential Vb (where Va>Vb) has been written to the data signal lines DB1 to DBn. Assuming that all pixels on the first row are not defective, the potentials that are read to the data signal lines DA1 to DAn are higher than the potentials that are read to the data signal lines DB1 to DBn.

Figure 9A:
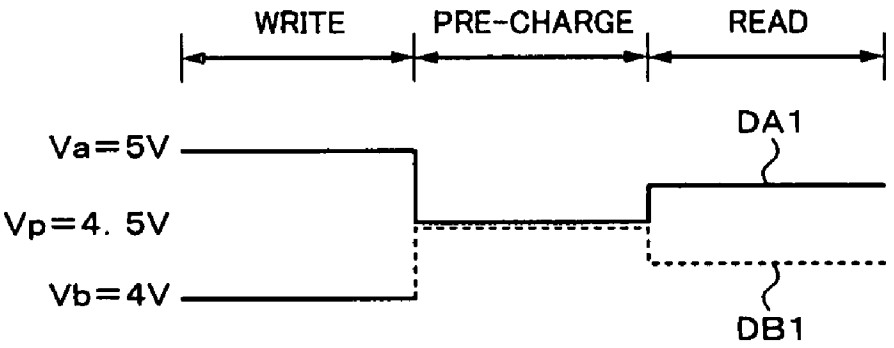
FIG. 9A and FIG. 9B are schematic diagrams showing voltage variations according to the embodiment of the present invention.
Figure 9B:
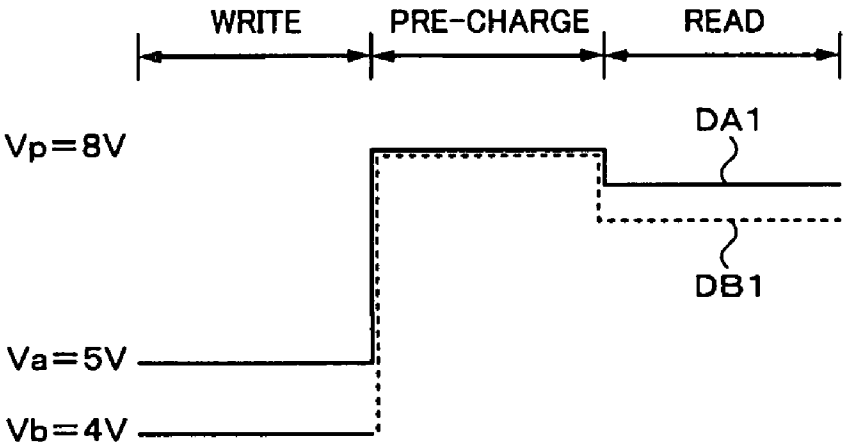

FIG. 9A and FIG. 9B show variations of potentials of the data signal lines in a writing process, a pre-charging process, and a reading process. As shown in FIG. 9A, when a writing process is performed, the signal potentials of data signal lines, for example, DA1 and DB1, are Va=5 V and Vb=4 V, respectively. The signal potentials are written to all pixels on the first row.

When a pre-charging process is performed, a signal potential Vp=4.5 V is applied to all the data signal lines. Thereafter, signal potentials are read from all the pixels on the first row. In this case, when two adjacent pixels on the first row are not defective, the potential that is read to the data signal line DA1 becomes, for example, 4.7 V, which is higher than the potential that is read to the data signal line DB1, for example, 4.3 V. As a result, the compared output of the comparator CMP1 becomes "H".

FIG. 9B shows an example of which the reference potential Vp (Vp>Va) is, for example, Vp=8 V. In this example, when a pre-charging process is performed, the data signal lines are pre-charged to 8 V. When a reading process is performed, charges are read from the capacitors Cs of the pixels. When each pixel is not defective, a potential that is read to, for example, the data signal line DA1 is higher than a potential that is read to the data signal line DB1 denoted by a dashed line.

When potentials of the data signal lines DA1 to DAn are higher than potentials of the data signal lines DB1 to DBn, respectively, the comparators CMP1 to CMPn generate, for example, compared outputs "H". When the relation is inverse, the comparators CMP1 to CMPn generate compared outputs "L". When the potentials of the data signal lines DA1 to DAn are equal to the potentials of the data signal lines DB1 to DBn, respectively, the comparators CMP1 to CMPn generate, for example, compared outputs "L". Thus, when all outputs of the comparators CMP1 to CMPn are "H", it can be determined that all the pixels on the first row are normal. When at least one of the outputs of the comparators CMP1 to CMPn is "L", it is determined that the pixels on the first row contains a defective pixel.

In other words, when the potential Va is written to a pixel, if a potential lower than the potential Vb is read therefrom, it is determined that the pixel is, for example, a pixel that has a capacitor Cs with a large leak, a pixel that has a pixel transistor to which the potential Va cannot be written, or a pixel that is short-circuited to the ground. On the other hand, when the potential Vb is written to a pixel, if a potential higher than the potential Va is read therefrom, it is determined that the pixel is, for example, a pixel that has been highly pulled up, a pixel that has a pixel transistor that is always turned on, or a pixel that has a pixel transistor that is always turned off.

After the reading process S22 for the pixels on the first row and the comparing process S23 for the pixels on the first row have been completed, a reading process for pixels on the second row and a comparing process for pixels on the second row are performed. Thereafter, a reading process and a comparing process are repeated until all pixels on the V-th row of the substrate have been inspected for defective ones. The inspected result for pixels on each row is displayed on a screen of a display unit (not shown) connected to the computer 23 of the inspecting system shown in FIG. 5 and, when necessary, output to a printer (not shown).

As shown in FIG. 6, after the first writing process and the first reading process have been completed, the signal potential Va and the signal potential Vb that are supplied to the input terminals 14*a* and 14*b* are substituted for each other at step S30. In other words, the signal potential Va is supplied to the input terminal 14*b*, whereas the signal potential Vb is supplied to the input signal terminal 14*a*. Thereafter, the second writing process S40 and the second reading process S50 that are the same as the first writing process S10 and the first reading process S20, respectively, are performed.

In the first writing process and the first reading process, the relative relation of (Va>Vb) is detected. Thus, if the voltage Va is written to a pixel and the voltage Va varies to a higher voltage in the pixel, it cannot be detected as a defective pixel. Likewise, if the voltage Vb is written to a pixel and the voltage Vb varies to a lower voltage in the pixel, it cannot be detected as a defective pixel. However, even if there is such a defective pixel, when the foregoing signal voltage substituting process is performed, the defective pixel can be detected. After the substituting process has been performed, when there is no defective pixel, the comparators output "L". When there is a defective pixel, the comparators output "H".

Second Embodiment

Figure 10:
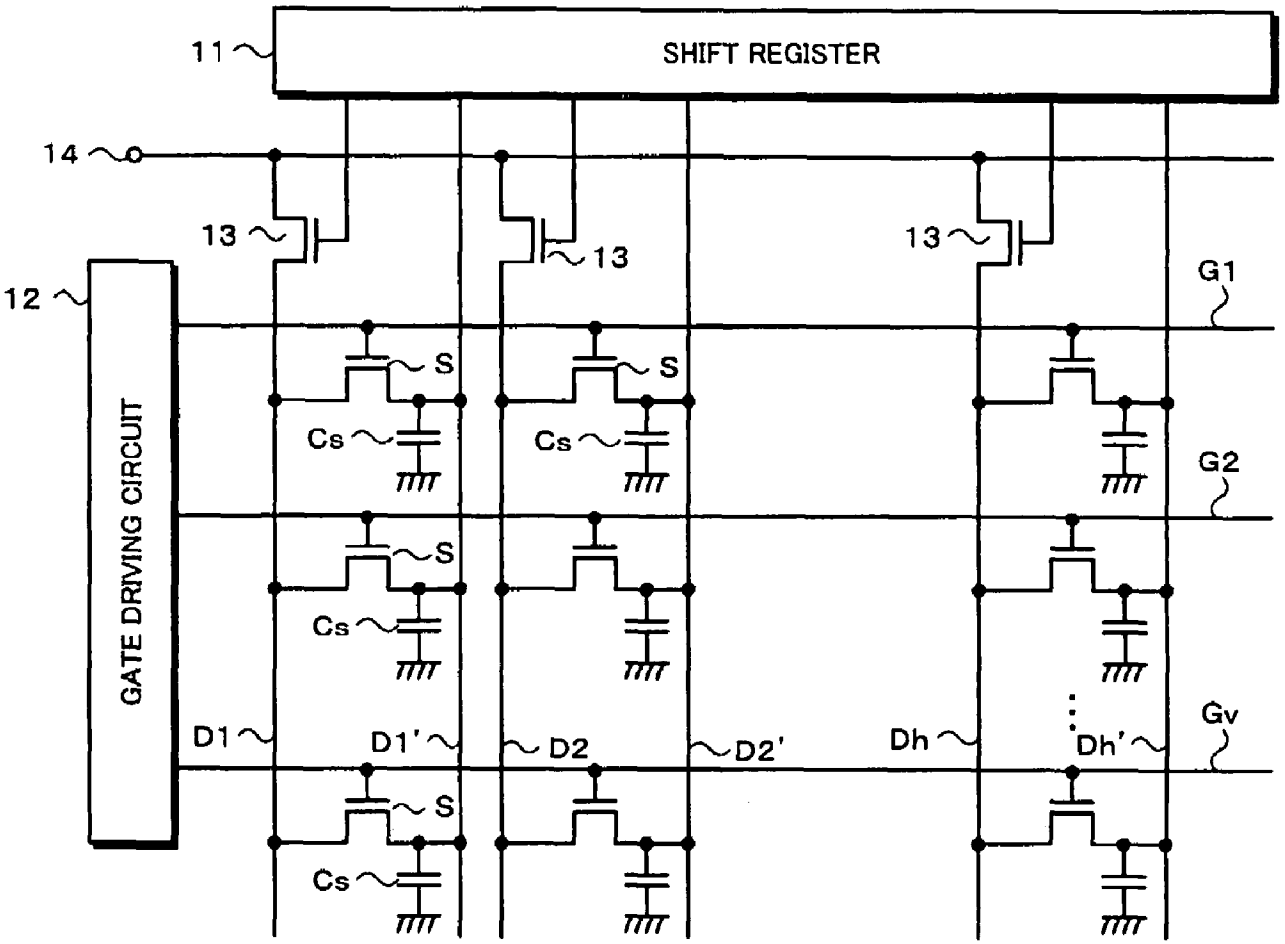
FIG. 10 is a circuit connection diagrams showing a structure of another embodiment of the present invention.

FIG. 10 shows another embodiment (second embodiment) of the present invention. For simplicity, in FIG. 10, similar portions to those in FIG. 2 will be denoted by similar reference numerals. In the second embodiment, signal voltages are not written to a plurality of pixels in parallel. Instead, a signal voltage is written to pixels one by one. Thus, there are h data lines D1 to Dh. There are v gate signal lines G1 to Gv. A signal voltage is applied to an input terminal 14. When one transistor 13 is turned on, the voltage is written thereto in a point sequence.

Figure 11:
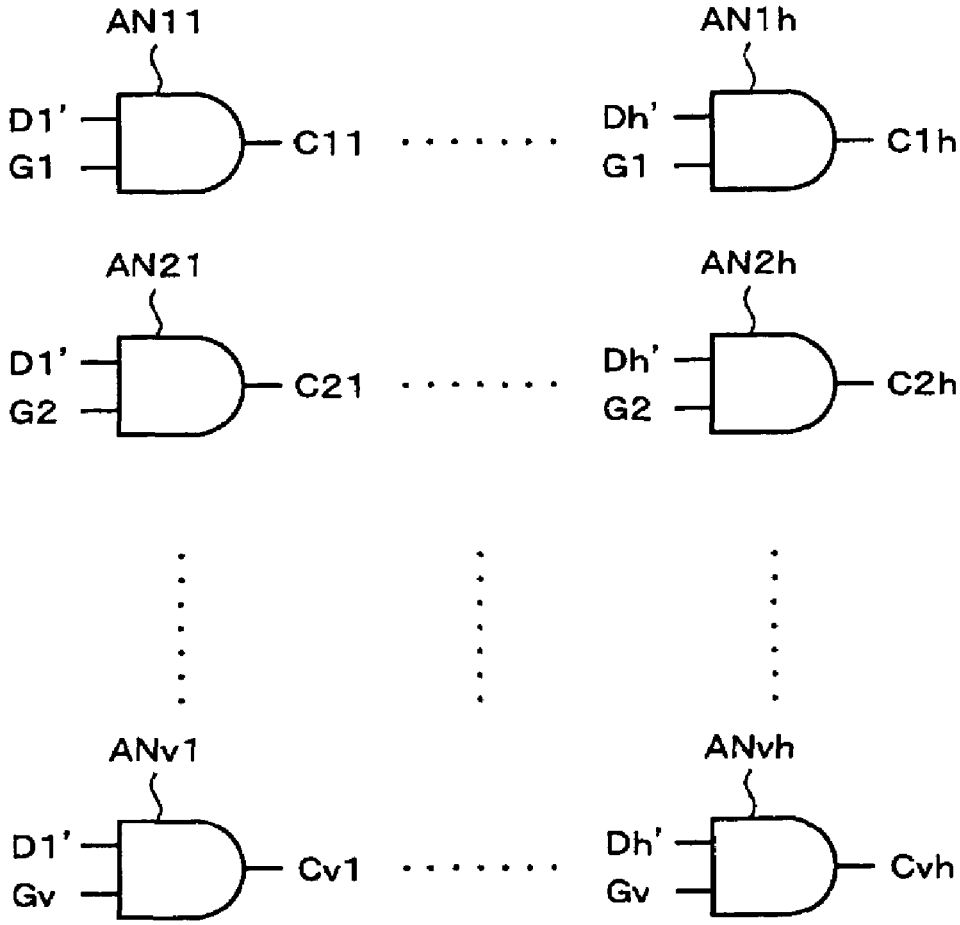
FIG. 11 is a block diagram showing a structure for generating inspection outputs corresponding to individual pixels according to the other embodiment of the present invention.

In the second embodiment, auxiliary data signal lines D1' to Dn' are disposed in parallel with the data signal lines D1 to Dn, respectively. Each of connected points of pixel transistors S and capacitors Cs of pixel portions is connected to the auxiliary data signal lines D1' to Dn'. In addition, as shown in FIG. 11, AND gates AN11 to ANvh are disposed corresponding to all the pixels. A voltage of the auxiliary data signal line D1' and a voltage of a gate signal line G1 are input to the AND gate AN11. A voltage of the auxiliary data signal line D1' and a voltage of the gate signal line G2 are input to the AND gate AN21. Likewise, a voltage of an auxiliary data signal line Dj and a voltage of a gate signal line Gi are input to an AND gate ANij.

Figure 12:
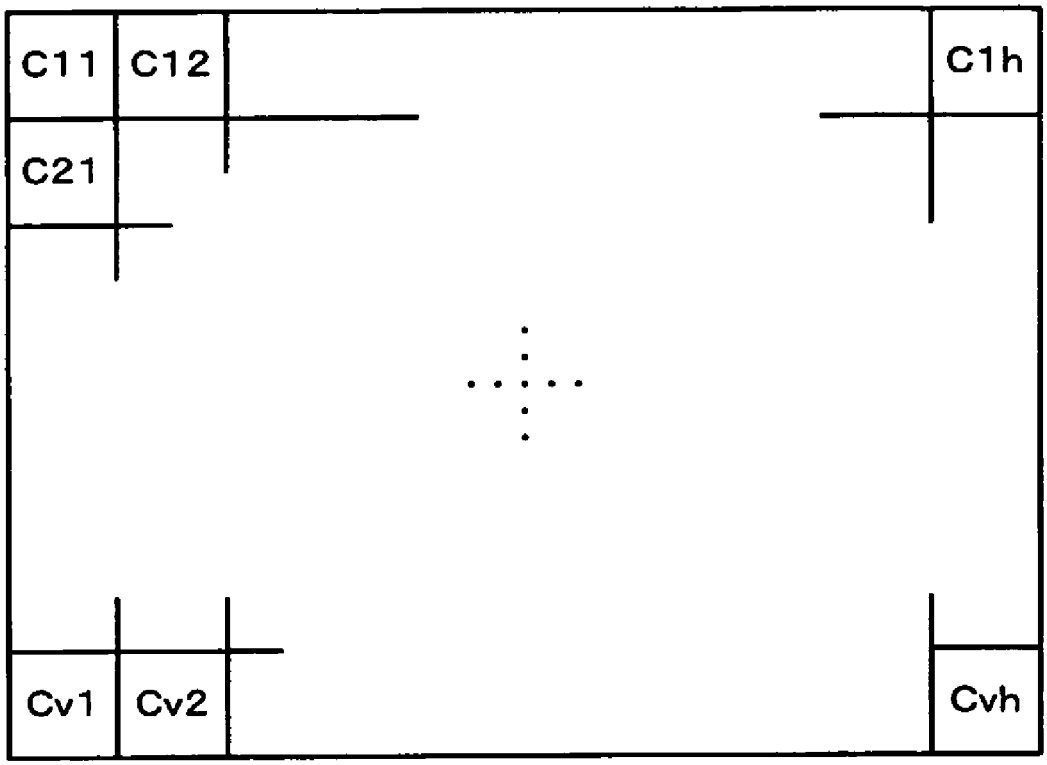
FIG. 12 is a schematic diagram showing an example of a process for inspection outputs corresponding to individual pixels.

Outputs C11 to Cvh of the AND gates AN11 to ANvh are stored in, for example, an external memory. As shown in FIG. 12, a bit map is structured. The bit map is displayed as dots on the display unit under the control of the computer. In addition, the software installed to the computer causes the number of pixels that are "H" or "L" on the bit map to be counted as the number of normal pixels or the number of defective pixels. In addition, information that represents positions of defective pixels on the bit map is created by the computer.

In the second embodiment of the present invention, when pixels are inspected for defective ones, a predetermined voltage is applied to the signal input terminal 14 so as to charge the voltage to capacitors Cs of all pixels. In this case, it is determined whether or not the predetermined voltage has been charged to the pixel portions with the outputs C11 to Cvh of the AND gates AN11 to ANvh. When the predetermined voltage has been charged to each pixel portion, the output of the corresponding AND gate becomes "H". Otherwise, the output of the AND gate becomes "L". The outputs C11 to Cvh are stored as a bit map in the memory. Positions of the AND gates that generate "L" bits are detected as defective pixels.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention. For example, it is not always necessary to supply potentials of two adjacent data signal lines to comparators. In other words, potentials of two non-adjacent data signal lines may be input to comparators. In addition, the present invention can be applied not only to a substrate for a reflection type liquid crystal display device, but also to a substrate for a transparent-type liquid crystal display device.

In the foregoing embodiment, a method of inspecting defective pixels with different voltages supplied to two data signal lines was described. When AND circuits are used instead of comparators, it could be determined whether or not there are defective pixels with a single voltage. In other words, when a pixel under test is not defective, two inputs of a corresponding AND circuit are "H" and an output thereof is "H". However, if a capacitor of the pixel is defective, the output of the corresponding AND circuit is "L". In such a manner, a defective pixel can be detected.

According to the present invention, it can be determined whether or not there are defective pixels with a digital signal. In comparison with a method of determining whether there are defective pixels with an analog waveform, pixels can be easily inspected. In addition, the inspection time can be shortened. Moreover, according to the present invention, the pixels can be inspected without the influence of deviations of a parasitic capacitance of data signal lines and a capacitance of an evaluating system (for example, a tester system).

What is claimed is:

1. A method for inspecting a liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the method comprising the steps of:

supplying different voltages to two data signal lines and storing the two different voltages to the capacitors through the respective pixel transistors connected to the two data signal lines;

for each gate signal line, reading the voltages stored in the capacitors at the intersections of said gate signal line and the two data signal lines;

comparing the voltages that are read with a comparing means; and detecting defective pixels based upon the result of said comparison.

2. A liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the liquid crystal display device comprising:

comparing means for comparing voltages of the output signals from at least two data signal lines.

3. The liquid crystal display device as set forth in claim 2, further comprising:

detecting means connected to the comparing means for detecting defective pixels.

4. The liquid crystal display device as set forth in claim 3, wherein the detecting means is composed of exclusive OR means.

5. The liquid crystal display device as set forth in claim 2, further comprising:

data converting means connected to the comparing means for converting parallelly supplied data into serial data and outputting the serial data.

6. A liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the liquid crystal display device comprising:

means disposed at intervals of two of the data signal lines for comparing voltages of the two data signal lines.

7. The liquid crystal display device as set forth in claim 6, further comprising:

exclusive OR means connected to the comparing means.

8. The liquid crystal display device as set forth in claim 6, further comprising:

data converting means connected to the comparing means for converting parallelly supplied data into serial data and outputting the serial data.

9. A liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the liquid crystal display device comprising:

a plurality of auxiliary data signal lines disposed corresponding to the data signal lines and connected to the output electrodes of the respective pixel transistors; and calculating means connected to one of the auxiliary data signal lines and one of the gate signal lines.

10. A method for inspecting a liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the method comprising the steps of:

supplying two predetermined different voltages to two adjacent data signal lines and storing the two predetermined different voltages to capacitors connected to the two signal lines through the respective pixel transistors; and comparing voltages that are read from the capacitors to the two data signal lines.

11. A method for inspecting a liquid crystal display device having a plurality of data signal lines, a plurality of gate signal lines disposed intersection to the data signal lines, pixel transistors disposed at intersections of the data signal lines and the gate signal lines, and capacitors disposed at the intersections, the pixel transistors each having a control electrode, an input electrode, and an output electrode, at the intersections, the control electrodes of the pixel transistors being connected to the respective gate signal lines, the input electrodes of the pixel transistors being connected to the respective data signal lines, the output electrodes of the pixel transistors being connected to the respective capacitors, the method comprising the steps of:

supplying different voltages to two data signal lines and storing the two different voltages to the capacitors through the respective pixel transistors connected to the two data signal lines;

pre-charging a reference potential to all the data signal lines and reading voltages stored in the capacitors to the two data signal lines; and comparing the voltages of the two data signal lines.

12. The method as set forth in claim 11, further comprising the step of:

inverting the voltages applied to the two data signal lines and performing the supplying step, the pre-charging step, and the comparing step in succession.

* * * * *